US011097347B2

(12) United States Patent
Nishimura et al.

(10) Patent No.: US 11,097,347 B2
(45) Date of Patent: Aug. 24, 2021

(54) METHOD OF PRODUCING ATOMIZED POWDER AND METHOD OF MANUFACTURING MAGNETIC CORE

(71) Applicant: HITACHI METALS, LTD., Tokyo (JP)

(72) Inventors: Kazunori Nishimura, Minato-ku (JP); Shin Noguchi, Minato-ku (JP); Nobuaki Yoshioka, Minato-ku (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/497,616

(22) PCT Filed: Mar. 23, 2018

(86) PCT No.: PCT/JP2018/011857
§ 371 (c)(1),
(2) Date: Sep. 25, 2019

(87) PCT Pub. No.: WO2018/181046
PCT Pub. Date: Oct. 4, 2018

(65) Prior Publication Data

US 2020/0047255 A1 Feb. 13, 2020

(30) Foreign Application Priority Data

Mar. 27, 2017 (JP) ..... JP2017-061682

(51) Int. Cl.
*B22F 9/08* (2006.01)
*B03C 1/247* (2006.01)
(Continued)

(52) U.S. Cl.
CPC ..... *B22F 9/08* (2013.01); *B03C 1/247* (2013.01); *B22F 3/105* (2013.01); *B22F 3/24* (2013.01);
(Continued)

(58) Field of Classification Search
CPC .... B22F 9/08; B22F 2009/0828; B22F 3/105; B22F 3/24; B22F 2003/248; B22F 3/16;
(Continued)

(56) References Cited

U.S. PATENT DOCUMENTS 4,191,516 A * 3/1980 Dain ..... B22F 9/082 264/11
4,298,553 A 11/1981 Ayers

FOREIGN PATENT DOCUMENTS

CN 203209169 U * 9/2013
CN 203209169 U 9/2013
(Continued)

OTHER PUBLICATIONS

Translation of International Preliminary Report on Patentability in International Application No. PCT/JP2018/011857, dated Oct. 3, 2019.
(Continued)

*Primary Examiner* — Rebecca Janssen
(74) *Attorney, Agent, or Firm* — Sughrue Mion, PLLC

(57) ABSTRACT

A method of producing an atomized powder includes: an atomizing step of forming magnetic alloy particles from a molten metal by an atomizing method, to obtain a slurry in which the magnetic alloy particles are dispersed in an aqueous dispersion medium; a slurry concentration step of causing magnetic separation means to separate the magnetic alloy particles from the slurry to form a concentrated slurry having the magnetic alloy particles of more than 80% by mass, the magnetic separation means using a rotary drum including a magnetic circuit part fixedly disposed at a position where at least a part of the magnetic circuit part is immersed in the slurry and an outer sleeve capable of rotating outside the magnetic circuit part; and a drying step
(Continued)

of causing drying means using an air flow dryer to dry the concentrated slurry to form a magnetic alloy powder.

15 Claims, 5 Drawing Sheets

(51) Int. Cl.
*B22F 3/105* (2006.01)
*B22F 3/24* (2006.01)
*H01F 41/02* (2006.01)

(52) U.S. Cl.
CPC ..... *H01F 41/02* (2013.01); *B22F 2003/248* (2013.01)

(58) Field of Classification Search
CPC .. B22F 2009/0872; B22F 9/082; B03C 1/247; B03C 2201/18; B03C 1/0332; B03C 1/14; B03C 1/30; H01F 1/20; H01F 1/33; H01F 41/0246; H01F 41/02; C22C 19/03; C22C 38/00; C22C 33/0278; C22C 33/0207; C22C 2202/02
See application file for complete search history.

(56) References Cited

FOREIGN PATENT DOCUMENTS

| | | | | |
|---|---|---|---|---|
| CN | 204911455 | U | * | 12/2015 |
| JP | 61-264107 | A | | 11/1986 |
| JP | 61264107 | A | * | 11/1986 |
| JP | 62-44509 | A | * | 2/1987 |
| JP | 62-044509 | A | | 2/1987 |
| JP | 62044509 | A | * | 2/1987 |
| JP | 3170606 | A | * | 11/1989 |
| JP | 3-170606 | A | | 7/1991 |
| JP | 8-092608 | A | | 4/1996 |
| JP | 3052843 | U | * | 10/1998 |
| JP | 3052843 | U | | 10/1998 |
| JP | 2006-134958 | A | | 5/2006 |
| JP | 2009-88496 | A | | 4/2009 |

OTHER PUBLICATIONS

International Search Report for PCT/JP2018/011857 dated May 29, 2018 (PCT/ISA/210).
Japanese Decision to Grant a Patent for JPA No. 2019-509732 dated May 23, 2019.
Extended European Search Report dated Oct. 20, 2020 in European Application No. 18774176.4.

* cited by examiner

METHOD OF PRODUCING ATOMIZED POWDER AND METHOD OF MANUFACTURING MAGNETIC CORE

CROSS REFERENCE TO RELATED APPLICATIONS

This application is a National Stage of International Application No. PCT/JP2018/011857 filed Mar. 23, 2018, claiming priority based on Japanese Patent Application No. 2017-061682, filed Mar. 27, 2017.

TECHNICAL FIELD

The present invention relates to a method of producing an atomized powder and a method of manufacturing a magnetic core using the atomized powder.

BACKGROUND ART

Generally, when a magnetic core used for a transformer, an inductor, and a reactor and the like is prepared by powder metallurgy, a granular powder typified by an atomized powder is suitably used from the viewpoint of fluidity and the like as a soft magnetic metal material powder constituting the magnetic core. In particular, atomizing methods such as gas atomization and water atomization are suitable for preparing an alloy powder that has high malleability and ductility and is less likely to be pulverized. The water atomizing method has been known to be suitable for providing a fine metal powder of 35 μm or less having a substantially spherical shape.

The water atomizing method is a method in which a high-frequency melted metal is caused to flow down from a tundish through a ceramic heat-resistant nozzle, and high-pressure water is jetted to the metal to obtain a powder. The obtained metal powder is discharged as a slurry containing the water as a dispersion medium. The concentration (solid content concentration) of the metal powder in the slurry is about 1% by mass to about 17% by mass, and the water as the dispersion medium and the metal powder are separated from the slurry by a method such as natural sedimentation or magnetic adsorption (solid-liquid separation).

In the natural sedimentation, the metal powder is separated from the dispersion medium by the weight of the particles, so that a complex equipment device is not required without regard to whether the metal powder is magnetic or nonmagnetic. However, a usual batch system using a sedimentation tank causes a difficult continuous treatment. In the case of a metal powder containing particles having a relatively fine particle size having an average particle diameter D50 of 15 μm or less defined by a median diameter, it takes time to settle the particles, which makes it difficult to separate the metal powder at a high recovery rate in a short time.

In solid-liquid separation due to magnetic adsorption, metal powder particles are adsorbed by a magnetic rotary drum partially immersed in a slurry, and separated as a concentrated slurry. Since the slurry concentrated by magnetic adsorption contains moisture of 10% by mass to 30% by mass, it is necessary to further remove the moisture. For example, as shown in FIG. 10, in an apparatus disclosed in Patent Document 1, a slurry 808 concentrated by a magnetic rotary drum 819 is supplied onto a filter fabric conveyor 820, followed by dewatering using a vacuum exhauster 824.

Patent Document 2 also adopts a similar method. In addition, dewatering may be performed using a mechanical device used for squeezing and the like of a centrifugal machine, a filter pressing machine, a belt pressing machine, and a vacuum type filter and the like.

PRIOR ART DOCUMENTS

Patent Document

Patent Document 1: JP-A-03-170606
Patent Document 2: JP-A-08-092608

SUMMARY OF THE INVENTION

Problems to be Solved by the Invention

It is expected that the belt filter type vacuum dehydrators used in Patent Document 1 and Patent Document 2, and the filter used for squeezing, and the like are generally complicated, and large-scale equipment devices, and a filter cloth is clogged with a fine metal powder to cause a decreased recovery rate of the metal powder. It is expected that periodical filter cloth replacement and the like are required, which causes an increased cost for maintenance and the like. The metal powder subjected to the dewatering treatment has low moisture but it still contains water, which makes it necessary to further provide a drying step.

Then, it is an object of the present invention to provide a method of producing an atomized powder and a method of manufacturing a magnetic core that can easily recover a metal powder from a slurry containing an aqueous dispersion medium containing magnetic metal material particles obtained by an atomizing method in a short time.

Means for Solving the Problems

According to a first aspect of the present invention, there is provided a method of producing an atomized powder including: an atomizing step of forming magnetic alloy particles from a molten metal by an atomizing method, to obtain a slurry in which the magnetic alloy particles are dispersed in an aqueous dispersion medium; a slurry concentration step of causing magnetic separation means to separate the magnetic alloy particles from the slurry to form a concentrated slurry having the magnetic alloy particles of more than 80% by mass, the magnetic separation means using a rotary drum including a magnetic circuit part fixedly disposed at a position where at least a part of the magnetic circuit part is immersed in the slurry and an outer sleeve capable of rotating outside the magnetic circuit part; and a drying step of causing drying means using an air flow dryer to dry the concentrated slurry to form a magnetic alloy powder.

In the present invention, it is preferable that a concentrated slurry storage step is provided between the slurry concentration step and the drying step, and a slurry storage stirring device that can cause bubbling to stir the concentrated slurry in the concentrated slurry storage step is used.

In the present invention, it is preferable that: the slurry storage stirring device includes a container that stores the concentrated slurry; the container includes an inner body surrounding the concentrated slurry and including a porous body; and a gas is supplied as fine bubbles to the concentrated slurry through fine pores of the porous body.

In the present invention, it is preferable that a coarse powder removing step of sieving the slurry to form a slurry excluding a coarse powder of the magnetic alloy particles is provided between the atomizing step and the slurry concentration step.

In the present invention, it is preferable that: a slurry supply path between the atomizing step and the concentration step includes a storage container for storing the slurry; and the storage container includes stirring means for stirring the slurry.

In the present invention, it is preferable that: a pump for pumping the slurry is provided in a path between the atomizing step and the concentration step; and the slurry is constantly supplied to the slurry concentration step by the pump.

In the present invention, it is preferable that the magnetic separation means includes: a magnetic circuit part including a plurality of magnets fixedly disposed in an arc form; a magnetic opening part where the magnet is not disposed; a rotary drum including an outer sleeve capable of rotating outside the magnetic circuit part; a flow path for causing the slurry to flow in a direction opposite to a rotation direction along an outer periphery of the outer sleeve; a storage part for storing the slurry to be supplied to the flow path; and a discharge part that causes a scraper provided in the magnetic opening part to scrape magnetic alloy particles adsorbed to the outer sleeve in the magnetic circuit part with a dispersion medium to obtain a concentrated slurry.

In the present invention, it is preferable that the slurry in the storage part is stirred by the stirring means.

In the present invention, it is preferable that the separation means further includes a squeezing roller rotating in contact with the rotary drum.

In the present invention, it is preferable that the method includes a classification step of classifying the atomized powder after the drying step into a predetermined particle size to perform particle size adjustment.

In the present invention, it is preferable that, in the drying step, the concentrated slurry is dried by drying means using an air flow dryer that causes an air flow to carry the concentrated slurry to dry the concentrated slurry.

In the present invention, it is preferable that the magnetic alloy contains Fe as a main component and an element M (M is at least one of Si, Cr, and Al) that is more easily oxidized than Fe.

A second aspect of the present invention is a method of manufacturing a magnetic core including a pressing step of pressing magnetic alloy particles prepared by the first aspect of the present invention as a compact having a predetermined shape.

In the present invention, it is preferable that the method further includes a heat treatment step of annealing the compact at a temperature of 350° C. or higher.

In the present invention, it is preferable that the method includes a heat treatment step of heat-treating the compact at 650° C. to 900° C. in an atmosphere containing steam or an atmosphere containing oxygen to oxidize the magnetic alloy particles, thereby forming an oxide layer on surfaces of the particles, and causing the oxide layer to form grain boundaries that bind the magnetic alloy particles.

Effect of the Invention

The present invention makes it possible to provide a method of producing an atomized powder and a method of manufacturing a magnetic core that can easily recover a metal powder in a short time from a slurry containing the metal powder obtained by an atomizing method.

MODE FOR CARRYING OUT THE INVENTION

Figure 1:
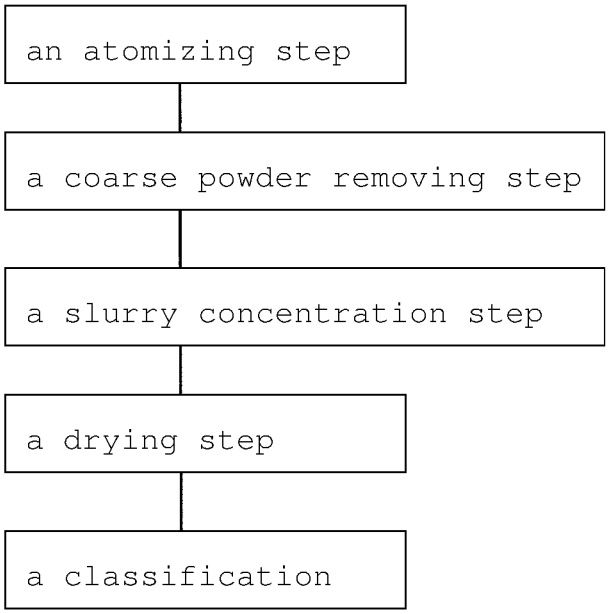
FIG. 1 is a flowchart for illustrating steps of a method of producing an atomized powder according to an embodiment of the present invention.

Hereinafter, a method of producing an atomized powder according to one embodiment of the present invention, and a method of manufacturing a magnetic core using the atomized powder obtained thereby will be specifically described. The present invention is not limited thereto, and can be changed as appropriate within the scope of the technical idea. In the drawings used for the description, an essential part is mainly described so that the gist of the invention can be easily understood, and the detail is appropriately omitted.

First Embodiment

Figure 2:
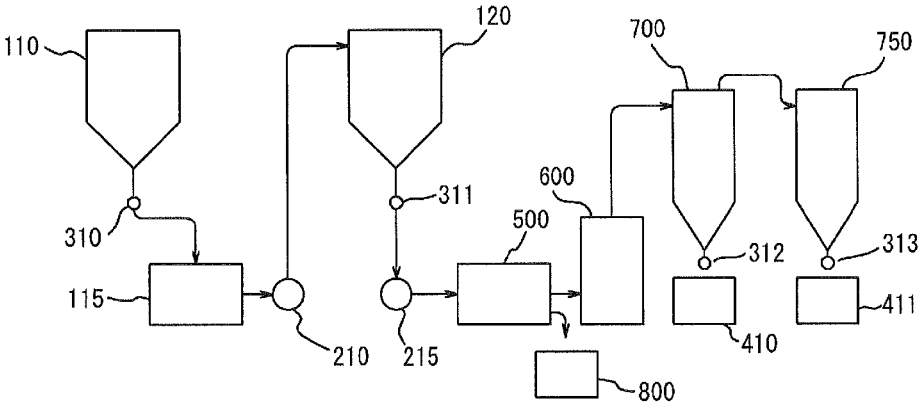
FIG. 2 is a view for illustrating the configuration of an atomized powder production device using a method of producing an atomized powder according to an embodiment of the present invention.

FIG. 1 is a flowchart showing a method of producing an atomized powder of the present invention. FIG. 2 shows a view for illustrating the configuration example of a producing device for an atomized powder corresponding to the flowchart of FIG. 1. In an atomized powder production plant, first, magnetic alloy particles having a desired composition are prepared by an atomizing method by an atomizing device 110 in an atomizing step.

In the case of a water atomizing method, a raw material weighed to have a predetermined alloy composition is melted by a high frequency heating furnace (not shown), or an alloy ingot preliminarily prepared to have an alloy composition is melted by a high frequency heating furnace to form a molten metal (hereinafter, referred to as a "molten metal"). By causing water jetted at a high speed and a high pressure to collide against the molten metal flowing down through a nozzle (not shown) provided on the bottom part of a tundish (not shown), the molten metal is microgranulated and cooled to obtain magnetic alloy particles. The average particle size of the obtained magnetic alloy particles is preferably 5 to 35 μm in a median diameter D50.

The magnetic alloy preferably contains, for example, Fe and an element M (M is at least one of Si, Cr, and Al) that is more easily oxidized than Fe. On the surfaces of the obtained magnetic alloy particles, a natural oxide film containing $Al_2O_3$, $Cr_2O_3$, or $SiO_2$ and the like as an oxide of the element M and having a thickness of about several nanometers to 50 nm is formed in a film form. When the natural oxide film becomes thick, the particles may become hard, which may cause impaired compactibility of the particles. When the natural oxide film becomes thin, hematite ($Fe_2O_3$) and the like is apt to be formed on the surfaces of the particles in a later step. This is red rust, which causes deteriorated quality of the particles. In a magnetic core in which the magnetic alloy particles are bound with an organic binder such as an acrylic resin or an epoxy resin, or an inorganic binder such as water glass, red rust may cause a deteriorated binder or a deteriorated strength. Therefore, the thickness of the natural oxide film is preferably 5 nm to 40 nm.

The atomized powder is an alloy containing Fe, Ni, or Co as a main component. For example, an Fe—Si alloy, an Fe—Cr alloy, an Fe—Cr—Si alloy, an Fe—Al alloy, an Fe—Al—Si alloy, an Fe—Al—Cr alloy, an Fe—Al—Cr—Si alloy, an Fe—Ni alloy, and a Co-based or an Fe-based crystalline or amorphous alloy. Preferably, an Fe—Si alloy containing 3 to 10% by mass of Si with the balance being Fe, an Fe—Cr—Si alloy containing 3.0 to 20% by mass of Cr and 5% by mass or less of Si with the balance being Fe, an Fe—Al—(Si) alloy containing 4.5 to 8.5% by mass of Al and 9.5% by mass or less of Si with the balance being Fe, an Fe—Al—Cr—Si alloy containing 2.0 to 10% by mass of Cr, 2.0 to 10% by mass of Al, and 5% by mass or less of Si with the balance being Fe, and an Fe—Ni alloy containing 45 to 80% by mass of Ni with the balance being Fe.

A slurry containing the magnetic alloy particles dispersed in an aqueous dispersion medium obtained by the atomizing method flows out of an atomizing device 110 through a valve 310. The aqueous dispersion medium is, for example, water or a mixed medium of water and a dispersant. If the surfaces of the magnetic alloy particles are covered with the natural oxide film, the ingress of oxygen into the particles is suppressed to prevent the formation of new oxides. This reduces a rust inhibitor and the like to be added to water as a dispersion medium as a rust preventive measure, or makes it unnecessary to add the rust inhibitor, to provide a simplified treatment of discharged water separated in a slurry concentration step to be described later, whereby the treatment cost can be reduced.

In the initial stage of atomization, a coarse metal powder of about several millimeters is apt to be produced. When the coarse metal powder is mixed in the slurry, pumps 210 and 215 for pumping the slurry cause biting, which may cause a damaged impeller. Therefore, it is preferable to provide a coarse powder removing step of causing the slurry to pass through a wet classifier 115 to obtain a slurry excluding a coarse powder of the magnetic alloy particles, between the atomizing step and the slurry concentration step. A vibrating sieve or a liquid cyclone may be used as the wet classifier 115. When the pump is not used to transport the slurry, the coarse powder removing step may be omitted.

When there is a difference between the granulation ability of the atomizing device and the processing ability of the subsequent step, it is preferable to temporarily store the slurry that has undergone the atomizing step in a storage container 120. The slurry can be constantly supplied to the subsequent step, and the slurry in the storage container 120 is stirred so that the magnetic alloy particles do not precipitate in a tank, whereby the slurry having a stable concentration can be supplied to the subsequent step. The slurry concentration step of the subsequent step can be stably performed, and the particles remaining in the discharged water that has undergone the slurry concentration step can be reduced, whereby the magnetic alloy particles can be efficiently recovered.

Figure 3:
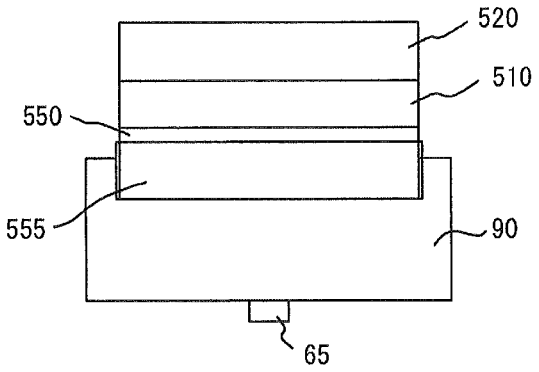
FIG. 3 is a front view showing the configuration example of a rotary drum type magnetic separation device used as magnetic separation means.
Figure 4:
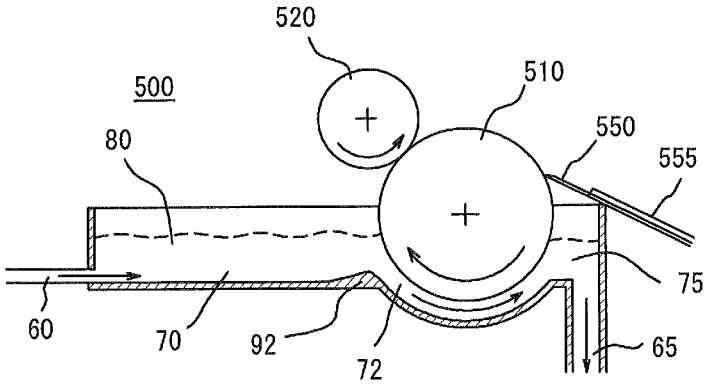
FIG. 4 is a cross-sectional view of the rotary drum type magnetic separation device shown in FIG. 3.
Figure 5:
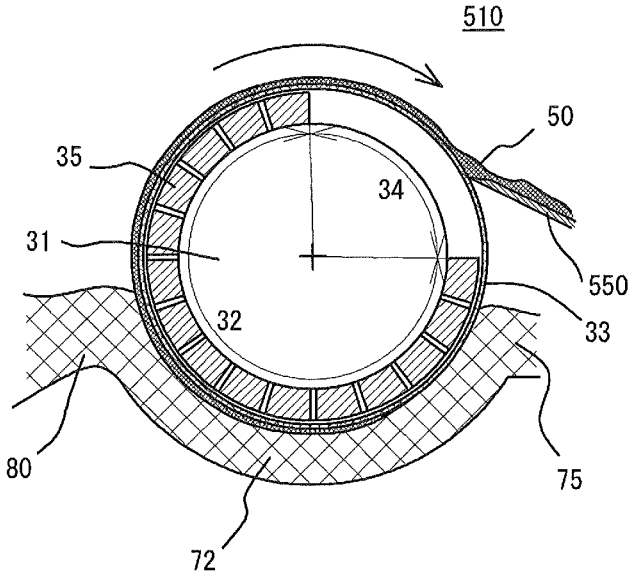
FIG. 5 is a cross-sectional view of an essential part including a rotary drum for illustrating a slurry concentration operation by the rotary drum type magnetic separation device shown in FIG. 3.

The slurry concentration step preferably employs magnetic separation means. As the magnetic separation means, for example, a rotary drum type magnetic separation device (hereinafter, separation device) can be suitably used. A front view showing an example of the structural example of the separation device is shown in FIG. 3. FIG. 4 shows the cross section of the separation device of FIG. 3, and FIG. 5 shows the enlarged cross sectional view of a rotary drum part. A separation device 500 includes a magnetic circuit part 32 fixedly disposed at least at a position to be immersed in a slurry 80, and an outer sleeve 33 capable of rotating outside the magnetic circuit part 32. In detail, the separation device 500 includes a magnetic circuit part 32 including a plurality of magnets 35 fixedly disposed in a row in an arc form, a magnetic opening part 34 in which the magnets 35 are not disposed, a rotary drum 510 including an outer sleeve 33 capable of rotating outside the magnetic circuit part 32 and the magnetic opening part 34, a flow path 72 for causing the slurry 80 to flow in a direction opposite to a rotation direction along the outer periphery of the outer sleeve 33, a storage part 70 for storing the slurry 80 to be supplied to the flow path 72, and a scraper 550 provided in the magnetic opening part 34.

The separation device 500 is generally disposed in a box-shaped frame body so that the axis of rotation of the rotary drum 510 is horizontal with respect to the bottom part of the frame body across the frame body. The frame body is divided into two of an upstream side and a downstream side by the rotary drum 510. The upstream side constitutes a storage part 70 for storing the slurry 80 from the atomizing step, and the downstream side serves as a discharged water storage part 75 as the separated dispersion medium. The flow path 72 connecting the storage part 70 and the discharged water storage part 75 to cause the slurry 80 to flow is formed at a predetermined interval following the outer periphery of the rotary drum 510 on the lower part of the rotary drum 510 and the bottom part of the frame body.

The slurry that has undergone the atomizing step is sent to the storage part 70 through a supply path 60. The flow volume of the slurry 80 of the storage part 70 is limited by the flow path 72 connecting the storage part 70 and the discharged water storage part 75, whereby the slurry 80 is accumulated in the storage part 70 for a given time period. It is preferable to stir the slurry 80 so that magnetic alloy particles do not precipitate in the tank of the storage part 70. Stirring may be performed by mechanical stirring means or ultrasonic diffusion, or the flow of the slurry from the supply path 60 may be utilized. For example, a baffle plate or a projection 92 may be provided for stirring on the inner side wall of the storage part 70 so that turbulence flow occurs in water flow in the storage part 70.

The outer sleeve 33 of the rotary drum 510 is formed of a nonmagnetic material such as stainless steel, and is disposed concentrically with an inner sleeve 31 having the magnets 35 disposed on the outer periphery thereof. In the illustrated example, the magnets 35 between the outer sleeve 33 and the inner sleeve 31 are fixedly disposed in a row substantially on ¾ of the outer periphery of the inner sleeve 31 to constitute the magnetic circuit part 32. The outer sleeve 33 is disposed in a state where the magnetic circuit part 32 is immersed in the slurry 80, and the magnetic alloy particles are adsorbed to the outer periphery of the outer sleeve 33 that rotates in a direction opposite to the flow direction of the slurry 80 between the storage part 70 and the discharged water storage part 75.

The magnet 35 to be used is not particularly limited, but if the magnet 35 is a rare earth metal magnet such as a SmCo magnet or a NdFeB magnet, the rare earth metal magnet has a stronger magnetic force than that of a ferrite magnet, and ability sufficient for adsorbing and separating the magnetic alloy particles is obtained even if the nonmagnetic outer sleeve 33 is interposed, which is preferable.

No magnet is present on the remaining ¼ of the outer periphery of the inner sleeve 31, which provides the magnetic opening part 34 configured so as not to be less likely to be affected by the magnetic circuit part 32. The magnetic opening part 34 is at a position not immersed in the slurry 80, and the magnetic alloy particles that are pulled up from the slurry 80 by the rotation of the outer sleeve 33 and reach the magnetic opening part 34 contain water as the dispersion medium, and is a concentrated slurry concentrated to a slurry concentration exceeding 80% by mass.

In the illustrated example, a squeezing roller 520 that rotates in contact with the rotary drum is provided to apply a predetermined pressing force to the concentrated slurry on the surface of the outer sleeve to remove the water as the dispersion medium. This makes it possible to obtain a concentrated slurry having a higher slurry concentration. The squeezing roller 520 to be used may be made of an elastic rubber or a resin such as polyurethane or polyester.

A concentrated slurry 50 that has reached the magnetic opening part 34 is scraped off by the spatula scraper 550 in contact with the surface of the outer sleeve 33, and slides down to a storage container by its own weight in an inclined recovery path 555. The separated water as the dispersion medium is discharged as discharged water to a discharged water container 800 from the discharged water storage part 75 through a discharge path 65.

The concentrated slurry is appropriately sent to the next drying step using conveying means such as a conveyor, and dried. A drying device is not particularly limited as long as it can supply a slurry having a slurry concentration exceeding 80% by mass, and an air flow dryer that introduces hot air (air flow) into the tube chamber 615 to cause the hot air to carry a powder to dry the powder is preferable. Such an air flow dryer is, for example, a Flash jet dryer manufactured by Seishin Enterprise Co., Ltd.

Figure 6:
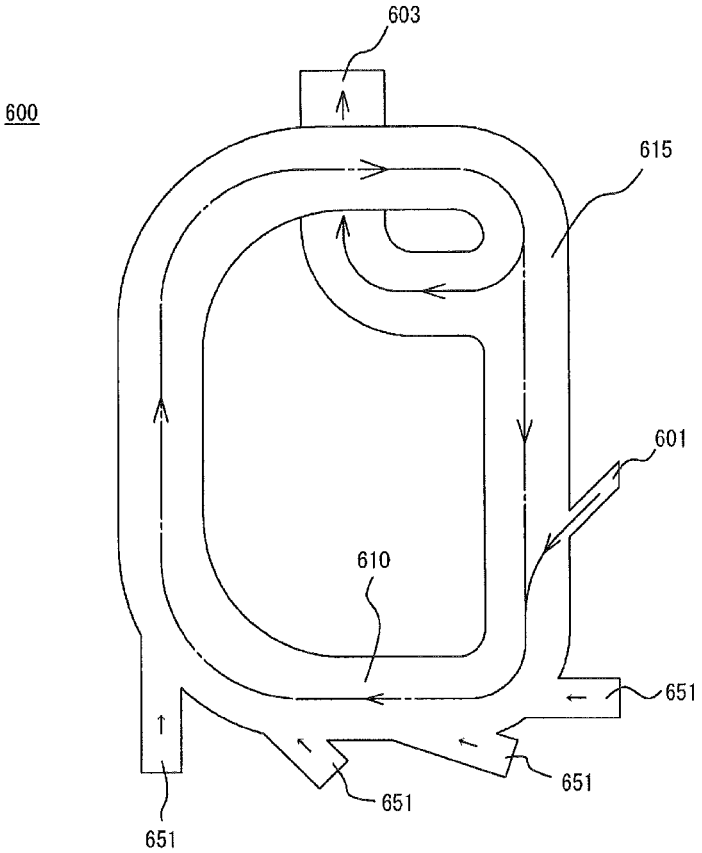
FIG. 6 is a view for illustrating the operation of an air flow dryer used as drying means.

FIG. 6 shows the structure of an air flow dryer used in one embodiment of a production method of the present invention. An air flow dryer 600 includes a supply part 601 for supplying a concentrated slurry, an annular tube chamber 615 for drying the concentrated slurry, a blast part 651 for sending hot air into the tube chamber 615, and a discharge part 603 for discharging the dried powder from the tube chamber 615.

Air supplied into the tube chamber 615 is set to 350° C. or higher by heating means such as a heater. The temperature, flow rate, and flow volume of the air to be supplied may be appropriately adjusted depending on the supply amount of the concentrated slurry and the concentration of the slurry. The air to be supplied has a high temperature of 200° C. or higher, but it is exclusively consumed as latent heat.

The concentrated slurry to be charged loses moisture while circulating in the tube chamber 615 together with heated air, and is dried. The collision of the particles provides magnetic alloy particles of which the aggregation has been released. As the drying proceeds in a circulation path 610, the weight of the material to be dried decreases. The magnetic alloy particles pass through the inner peripheral side of the annular tube chamber 615, and are discharged from the discharge part 603 together with the discharge air. The insufficiently dried matter circulates on the outer peripheral side in the tube chamber 615 by its own weight for continuous drying.

The magnetic alloy particles recovered from the air flow dryer 600 are sent to a hopper, and recovered in a container. Since the particle size of the obtained magnetic alloy particles has a distribution, the magnetic alloy particles may be classified into a plurality of particle sizes as necessary. As the classification method, as shown in the figure, a plurality of cyclone dust collectors 700 and 750 may be disposed after the air flow dryer 600, classified depending on the particle size of the magnetic alloy particles, and collected in containers 410 and 411 through valves 312 and 313. Sieve classification using a vibrating sieve and the like may be used.

As described above, the method of producing an atomized powder of the present invention makes it possible to easily recover the metal powder from the slurry containing the magnetic metal material particles obtained by the water atomizing method without using means such as compressing.

Second Embodiment

Figure 7:
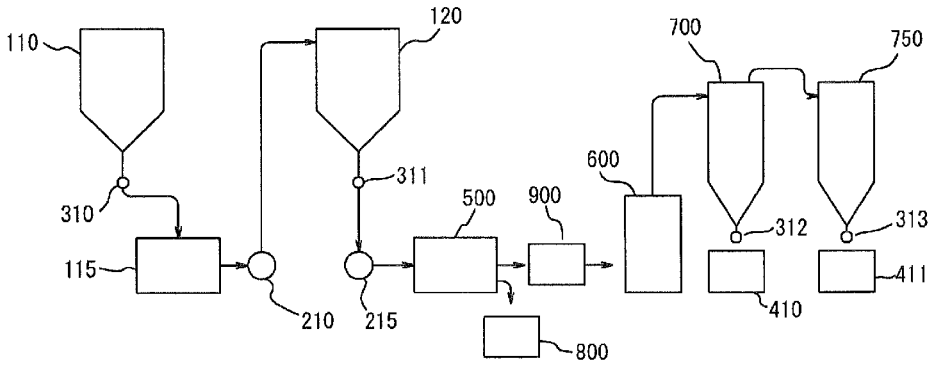
FIG. 7 is a view for illustrating a flow of steps of a method of producing an atomized powder according to an embodiment of the present invention.

A concentrated slurry storage step may be provided between a slurry concentration step and a drying step, and as shown in FIG. 7, a slurry storage stirring device 900 may be disposed between a separation device 500 and an air flow dryer 600. A concentrated slurry is likely to separate an aqueous dispersion medium from magnetic alloy particles, and has poor flowability. Therefore, it is preferable that the concentrated slurry is stored and stirred in a container of the slurry storage stirring device 900, whereby the concentrated slurry is supplied to the air flow dryer 600 by pumping using a pump and the like while the fluidity of the concentrated slurry is maintained.

Figure 8:
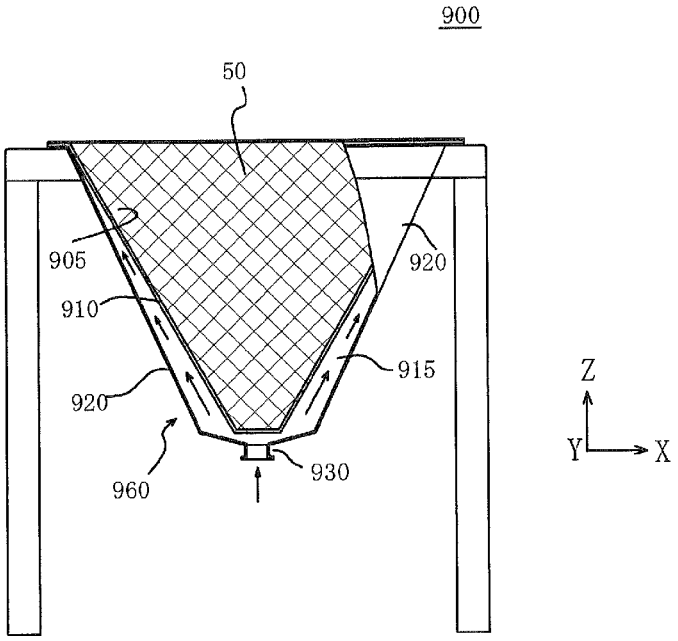
FIG. 8 is a partial cross-sectional view of a slurry storage stirring device used in a concentrated slurry storage step.

The structural example of the slurry storage stirring device is shown in FIG. 8. FIG. 8 shows a state where a part of the container is cut so that the structure can be easily understood. A compressor that sucks and compresses a gas and delivers it to the container, a pipe line connecting the container and the compressor, or a reinforcing beam and the like is omitted, and a flow path of the gas is indicated by an arrow.

The slurry storage stirring device 900 includes a conical container 960 whose cross-sectional area gradually decreases in the downward direction. A conical shape portion of the container 960 has a double structure of an inner body 910 and an outer body 920 provided on the outer side of the inner body 910. The inner body 910 is formed of a porous body having fine open pores (hereinafter, referred to as fine pores). The container 960 can be erected with a lower part thereof positioned above an installation surface by support legs.

A space 915 surrounded by the inner body 910 and the outer body 920 of the container is a path into which a gas supplied to a concentrated slurry 50 in the container flows, such as air for bubbling or an inert gas. The inner body 910 is formed of a porous body, and supplies fine bubbles to the concentrated slurry 50 in the container through a gas delivered to a space 915 through a gas supply port 930 provided on the lower part of the container from the compressor.

The inner body 910 has a hollow bottomed bowl shape, and an inclined surface 905 is configured to surround the concentrated slurry 50. The gas supplied from the compressor is blown into the concentrated slurry 50 through a large number of paths (fine pores) of the inner body 910 formed of a porous body. A large number of fine bubbles are dispersed in the concentrated slurry 50 from the porous body, and rise, which causes the fine bubbles to spread from the bottom part of the container to the upper part thereof. This allows the concentrated slurry 50 to be forcibly stirred to be in a fluid state. The gas to be supplied is air or an inert gas such as nitrogen.

The porous body constituting the inner body 910 may have at least fluid resistance that does not allow the solvent of the concentrated slurry 50 to pass therethrough, and withstand a load in a state where the porous body stores the concentrated slurry 50. Preferred materials are any of ceramic materials such as alumina and mullite, resin materials such as polyethylene and polypropylene, and metal materials such as titanium and stainless steel. In consideration of compactibility and processability, resin materials and metal materials are preferable, and from the viewpoints of abrasion resistance and corrosion resistance, the porous body is preferably formed of a metal material such as stainless steel. The material of the other portion of the container and the like in contact with the slurry is also preferably a metal material such as stainless steel from the viewpoints of abrasion resistance and corrosion resistance.

Third Embodiment

Figure 9:
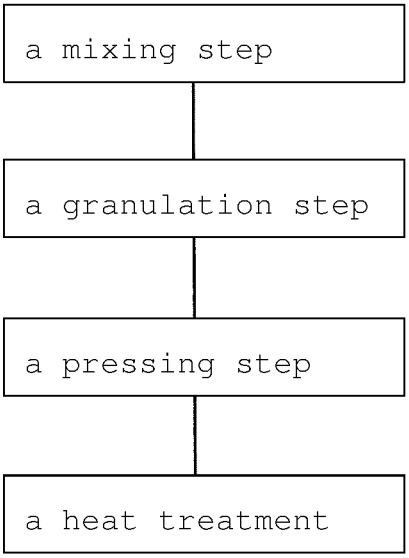
FIG. 9 is a flowchart for illustrating a method of manufacturing a magnetic core according to an embodiment of the present invention.
Figure 10:
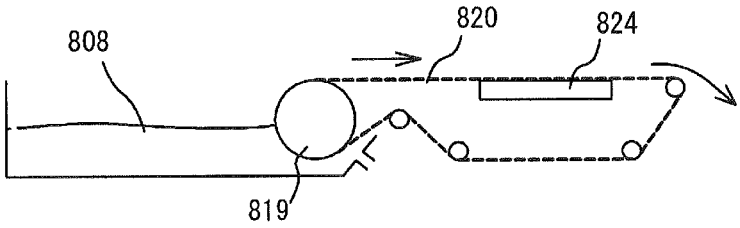
FIG. 10 is a view for illustrating the configuration of a conventional atomized powder production device.

Next, a method of manufacturing a magnetic core using the obtained magnetic alloy particles will be described. FIG. 9 is a flowchart for illustrating steps of a method of manufacturing a magnetic core.

In a mixing step, a binder is added to magnetic alloy particles that have been appropriately classified, followed by mixing. The binder binds the particles to one another in the subsequent pressing step, to impart a strength that withstands grinding processing and the like after pressing and handling to a compact. As the binder, various thermoplastic organic binders such as polyethylene, polyvinyl alcohol (PVA), and an acrylic resin can be used. The organic binder is thermally decomposed by a heat treatment after pressing. Therefore, an inorganic binder such as a silicone resin or water glass that solidifies and remains even after the heat treatment to bind powders may be used in combination. The amount of the binder to be added may be such that the binder can be sufficiently spread between the soft magnetic material powders to ensure a sufficient compact strength.

Next, in a granulation step, a granulated powder is obtained from a mixture obtained by mixing. It is preferable to use a spray drying machine such as a spray drier for granulation. The spray drying provides a granulated powder having a sharp particle size distribution and a small average particle size. By using such a granulated powder, processability after pressing to be described later is improved. The spray drying can provide a substantially spherical granulated powder, so that powder feeding properties (powder flowability) during pressing are also improved. The average particle size (median diameter D50) of the granulated powder is preferably 40 to 150 μm.

Next, in the pressing step, the granulated powder obtained in the granulation step is pressed into a predetermined magnetic core shape. The granulated powder is filled in a pressing die, and pressure-pressed into a predetermined shape such as a cylindrical shape, a rectangular solid shape, or a toroidal shape. Typically, the granulated powder can be pressed at a pressure of 0.5 GPa or more and 2 GPa or less for a retention time of several seconds. The pressure and the retention time are appropriately set depending on the content of the organic binder and the required strength of the sufficient compact.

In order to obtain good magnetic properties, it is preferable to provide a heat treatment step to relieve a stress strain applied to the magnetic alloy particles in the pressing step and the like. A heat treatment temperature may be set at a temperature at which a stress relaxation effect is obtained, but it is preferably a temperature of 350° C. or higher. The retention time in the heat treatment is appropriately set depending on the size of the magnetic core, the treatment amount, and the allowable range of characteristic variation and the like, but it is preferably 0.5 to 3 hours.

It is also preferable to perform the heat treatment in an oxidizing atmosphere at a temperature of 650° C. or higher. When the magnetic alloy contains an element M (M is at least one of Si, Cr and Al) that is more easily oxidized than Fe, the heat treatment causes an oxide layer containing an oxide derived from the element M to be formed. The oxide layer serves as a grain boundary phase between the magnetic alloy particles to bond the particles. The oxide derived from the element M is obtained by reacting the magnetic alloy particles with oxygen to grow the particles, and is formed by an oxidation reaction that exceeds the natural oxidation of the particles. The heat treatment can be performed in an atmosphere in which oxygen is present, such as in the air or in a mixed gas of oxygen and an inert gas. The heat treatment can also be performed in an atmosphere in which steam is present, such as in a mixed gas of steam and an inert gas. A heat treatment temperature is not limited as long as sintering between the particles does not significantly occur, but it is preferably 900° C. or lower. More preferably, the heat treatment temperature is 850° C. or lower. Still more preferably, the heat treatment temperature is 800° C. or lower. The magnetic core obtained by the heat treatment has a higher strength than that of the magnetic core obtained by binding the particles with the binder, and a magnetic core having large resistance is likely to be obtained.

There may also be used a so-called metal composite type magnetic core in which magnetic alloy particles and a thermosetting resin such as an epoxy resin, a silicone resin, or a phenol resin are kneaded to form a composite magnetic material, and an air core coil and a metal powder material are integrally pressed. A slurry containing magnetic alloy particles, an organic solvent, and a binder such as polyvinyl butyral may be made into a sheet by known sheet pressing means such as a doctor blade method, followed by appropriately forming a coil pattern on the sheet and laminating to obtain a magnetic core.

A coil component using the magnetic core obtained as described above is used, for example, as a choke, an inductor, a reactor, and a transformer and the like. The coil component is suitable, for example, for PFC circuits employed in home appliances such as televisions and air conditioners, and power supply circuits for solar power generation, hybrid vehicles, and electric vehicles, and the like.

DESCRIPTION OF REFERENCE SIGNS

33 outer sleeve
32 magnetic circuit part

34 magnetic opening part
35 magnet
50 concentrated slurry
70 storage part
72 flow path
110 atomizing device
500 separation device
510 rotary drum
520 squeezing roller
550 scraper
600 air flow dryer
601 supply part
603 discharge part
615 tube chamber
651 blast part
700, 750 cyclone dust collector
900 slurry storage stirring device
910 inner body
960 container

The invention claimed is:

1. A method of producing an atomized powder, the method comprising:

forming magnetic alloy particles from a molten metal by an atomization, to obtain a slurry in which the magnetic alloy particles are dispersed in an aqueous dispersion medium;

a slurry concentration step of causing magnetic separation means to separate the magnetic alloy particles from the slurry to form a concentrated slurry having the magnetic alloy particles of more than 80% by mass, the magnetic separation means using a rotary drum including a magnetic circuit part fixedly disposed at a position where at least a part of the magnetic circuit part is immersed in the slurry and an outer sleeve capable of rotating outside the magnetic circuit part;

a drying step of causing drying means using an air flow dryer to dry the concentrated slurry to form a magnetic alloy powder; and a concentrated slurry storage step is provided between the slurry concentration step and the drying step, and the concentrated slurry is stirred.

2. The method of producing an atomized powder according to claim 1, wherein:

a slurry storage stirring device that can cause bubbling to stir the concentrated slurry in the concentrated slurry storage step is used.

3. The method of producing an atomized powder according to claim 2, wherein:

the slurry storage stirring device includes a container that stores the concentrated slurry;

the container includes an inner body surrounding the concentrated slurry and including a porous body; and a gas is supplied as fine bubbles to the concentrated slurry through fine pores of the porous body.

4. The method of producing an atomized powder according to claim 1, wherein a coarse powder removing step of sieving the slurry to form a slurry excluding a coarse powder of the magnetic alloy particles is provided between the forming and the slurry concentration step.

5. The method of producing an atomized powder according to claim 1, wherein:

a slurry supply path between the forming and the concentration step includes a storage container for storing the slurry; and the storage container includes stirring means for stirring the slurry.

6. The method of producing an atomized powder according to claim 1, wherein:

a pump for pumping the slurry is provided in a path between the forming and the concentration step; and the slurry is constantly supplied to the slurry concentration step by the pump.

7. The method of producing an atomized powder according to claim 1, wherein the magnetic separation means includes:

a magnetic circuit part including a plurality of magnets fixedly disposed in an arc form;

a magnetic opening part where the magnet is not disposed;

a rotary drum including an outer sleeve capable of rotating outside the magnetic circuit part;

a flow path for causing the slurry to flow in a direction opposite to a rotation direction along an outer periphery of the outer sleeve;

a storage part for storing the slurry to be supplied to the flow path; and a discharge part that causes a scraper provided in the magnetic opening part to scrape magnetic alloy particles adsorbed to the outer sleeve in the magnetic circuit part with a dispersion medium to obtain a concentrated slurry.

8. The method of producing an atomized powder according to claim 7, wherein the slurry in the storage part is stirred by stirring means.

9. The method of producing an atomized powder according to claim 1, wherein the separation means further includes a squeezing roller rotating in contact with the rotary drum.

10. The method of producing an atomized powder according to claim 1, wherein the method includes classifying the atomized powder after the drying step into a predetermined particle size to perform particle size adjustment.

11. The method of producing an atomized powder according to claim 1, wherein, in the drying step, the concentrated slurry is dried by drying means using an air flow dryer that causes an air flow to carry and dry the concentrated slurry.

12. The method of producing an atomized powder according to claim 1, wherein the magnetic alloy contains Fe as a main component and an element M (M is at least one of Si, Cr, and Al) that is more easily oxidized than Fe.

13. A method of manufacturing a magnetic core, the method comprising pressing magnetic alloy particles prepared by the method of producing an atomized powder according to claim 1 as a compact having a predetermined shape.

14. The method of manufacturing a magnetic core according to claim 13, further comprising annealing the compact at a temperature of 350° C. or higher.

15. The method of manufacturing a magnetic core according to claim 13, wherein the method includes heat-treating the compact at 650° C. to 900° C. in an atmosphere containing steam or an atmosphere containing oxygen to oxidize the magnetic alloy particles, thereby forming an oxide layer on surfaces of the particles, and causing the oxide layer to form grain boundaries that bind the magnetic alloy particles.

* * * * *